US005785108A

United States Patent [19]

Stangier et al.

[11] Patent Number: 5,785,108

[45] Date of Patent: Jul. 28, 1998

[54] APPARATUS AND METHOD FOR CHANGING PATTERN PLATES ON SHELL CASTING MOLDING MACHINE

[75] Inventors: Ulf Stangier, Ketsch; Reiner Rommel, Brühl, both of Germany

[73] Assignee: Adolf Hottinger Maschinenbau GmbH, Mannheim, Germany

[21] Appl. No.: 737,464

[22] PCT Filed: Mar. 8, 1995

[86] PCT No.: PCT/DE95/00318

§ 371 Date: Nov. 18, 1996

§ 102(e) Date: Nov. 18, 1996

[87] PCT Pub. No.: WO95/31303

PCT Pub. Date: Nov. 23, 1995

[30] Foreign Application Priority Data

May 18, 1994 [DE] Germany ..... 44 17 302.4

[51] Int. Cl.[6] ..... B22C 13/08

[52] U.S. Cl. ..... 164/21; 164/165; 164/166

[58] Field of Search ..... 164/21, 159, 165, 164/166

[56] References Cited

U.S. PATENT DOCUMENTS 4,059,144 11/1977 Esche .

FOREIGN PATENT DOCUMENTS

| | | | |
|---|---|---|---|
| 0 184 090 | 6/1986 | European Pat. Off. . | |
| 61-235042 | 10/1986 | Japan | 164/21 |
| 62-166051 | 7/1987 | Japan | 164/166 |
| 1671399 | 8/1991 | U.S.S.R. | 164/165 |
| 1191199 | 5/1970 | United Kingdom . | |

OTHER PUBLICATIONS

Patent Abstracts of Japan, vol. 13, No. 83, Feb. 27, 1989, Publication No. JP63281748 (Otaki Katsuharu) Nov. 18, 1988.

*Primary Examiner*—J. Reed Batten, Jr.

*Attorney, Agent, or Firm*—Bell Seltzer Intellectual Property Law Group of Alston & Bird llp

[57] ABSTRACT

A pattern plate carrier releasably mounts a pattern plate. The pattern plate carrier is rotatable to an inverted position, and a pattern plate changing device is provided for removing a pattern plate from the inverted carrier and replacing the removed pattern plate with a pre-heated substituting pattern plate.

14 Claims, 9 Drawing Sheets

APPARATUS AND METHOD FOR CHANGING PATTERN PLATES ON SHELL CASTING MOLDING MACHINE

BACKGROUND OF THE INVENTION

The invention relates to an apparatus for changing pattern plates in the production of Croning shell molds, wherein the pattern plate being in use has a working temperature from about 250° C. to 330° C. Furthermore, the invention relates to a method of changing pattern plates during the production of Croning shell molds, in particular with the use of the tool changing apparatus in accordance with the invention.

Croning shell molds are casting molds for sand casting, which are used in the so-called Croning shell molding process. Croning shell molds are produced by means of rotatable, heated pattern plates, over which a molding box or a pouring vessel is placed. On its side carrying the pattern contour, the pattern plate is supplied or coated with a pourable, thermosetting molding material, for example, molding sand. A Croning shell mold, also known as mold shell is formed, if possible, under the action of a vacuum applied to the rear side of the pattern plate, and by the caking as well as curing of the molding material on the heated surface of the pattern plate. The thickness of the shell is dependent on the curing time or temperature. Once the desired thickness of the shell formed by the molding material is reached, the entire arrangement is tilted by 180°. In this process, the molding material that has not cured drops from the shell under the action of gravity, or falls again into the pouring vessel. Since such a mold shell alone is unable to resist high casting pressures, it is often backfilled and compacted on its rear side with a conventional molding material. This occurs normally, in that the pattern plate, together with the mold box or the pouring vessel is tilted again by 180° and filled thereafter with a molding sand as is commonly used in the foundry practice, such as green sand, which may again be compacted under the action of a pressure difference between the pattern plate and the sand surface. Subsequently, the pouring vessel together with the thus-produced casting mold is raised upward from the pattern plate. This upward movement may be assisted by an overpressure which acts upon the shell mold surface from the side of the pattern plate.

An apparatus for making Croning shell molds of the above-described type is known, for example, from DE-OS 34 44 342 and corresponding European Patent 0184090. This type of apparatus includes pattern plates—in single station or multistation arrangements—that are generally mounted by mechanical means, such as, for example, screws or the like, to a pattern plate carrier. In this arrangement, a change of pattern plates is always connected with a prolonged shutdown of the entire arrangement. During such a change, the operating personnel are exposed to considerable thermal and physical stress as a result of the pattern plates that are heated in the machine to temperatures from 250° C. to 330° C.

A further and quite considerable disadvantage of the known arrangement may be seen in that during a tool change, the substituting pattern plates are supplied to the pattern plate carrier substantially at room temperature, so that prior to a renewed production of shell molds, it is necessary to heat the substituting pattern plate in the machine. This is time-intensive and requires a prolonged shutdown of the machine in the form of a preparation time.

It is therefore the object of the present invention to provide a tool changing device for changing pattern plates during the production of Croning shell molds, which facilitates a faster and yet simpler exchange of pattern plates in the machine without prolonged shutdown times. It is a further object to provide a corresponding method of changing pattern plates during the production of Croning shell molds.

SUMMARY OF THE INVENTION

The above and other objects and advantages of the present invention are achieved by the provision of an apparatus and method for exchanging pattern plates used in the production of shell casting molds and wherein the removed pattern plate is replaced with a substituting pattern plate which is preheated to the working temperature.

In accordance with the invention, it has been found that a time-intensive heating of a substituting pattern plate caused quite substantial shutdown times of the machine. These shutdown times can be avoided in that the substituting pattern plate is already preheated to the working temperature that is required in the machine. This can be realized in a surprisingly simple manner by providing a special preheating device, which prepares the substituting pattern plate. Therefore, after a change of pattern plates, a heating phase of the substituting pattern plate is no longer necessary. Instead, the production of Croning shell molds may start immediately after installing the new pattern plate. Time-intensive and, consequently, cost-intensive shutdown times are thus largely avoided, at least with respect to the conventional heating of the substituting pattern plate. Furthermore, the replaced pattern plate may also be allowed to gradually cool on or in the preheating device, after deactivating same, so that even to this end no further handling problems are incurred.

With respect to construction, it will be highly advantageous, when the preheating device is associated with a pattern plate exchange carriage, which travels in the region of the carrier mounting the pattern plate. This pattern plate exchange carriage may also be used for receiving the pattern plate that is to be replaced, so that it is possible to accommodate thereon both the substituting pattern plate and the pattern plate being replaced. To this end, it would also be possible to provide the pattern plate exchange carriage with at least two supports for receiving the pattern plates and two preheating devices respectively associated with the supports. These preheating devices may be activated independently of each other and employ electric heaters or, for example, even gas burners.

The pattern plate in use is mounted on a carrier which is rotatable, preferably about a horizontal axis, and connected, via a coupling device, to a pouring vessel that is likewise rotatable, preferably about a horizontal axis. When pivoting the pouring vessel upward, the pattern plate carrier may be disconnected from the pouring vessel. After disconnecting the pattern plate carrier, same may be again rotated, together with the pattern plate, to a downward directed transfer position. To this end, the pattern plate is rotated downward, preferably by 180°.

More specifically, the pouring vessel may be arranged for pivoting about a horizontal axis formed on the side facing away from the pattern plate carrier, by means of a pivoting device that is operative preferably via a rocking lever. The pattern plate carrier itself may be arranged for rotation about a horizontal axis, preferably formed in the center, with the axis of rotation of the pouring vessel on the one hand and that of the pattern plate carrier on the other extending parallel to one another. Essential in any event is that the pattern plate carrier be by all means supported for rotation or pivotal movement, it being possible to make total use of this anyhow present rotatability for the tool change.

The coupling device that operates between the pattern plate carrier and the pouring vessel may comprise a coupling jaw, preferably associated with the pouring vessel, and a coupling shaft, preferably associated with the pattern plate carrier, as well as coupling rolls, if need be. When raising the pouring vessel, the coupling claw associated thereto disengages from the coupling shaft associated with the pattern plate carrier, so that the pattern plate carrier can be rotated or pivoted about its preferably central axis.

With respect to a fully automatic tool change, it will be further of advantage, when the pattern plate exchange carriage can be brought or moved below the preferably downward rotated pattern plate carrier. This movement could occur by hand, an electric motor, or via a hydraulic or pneumatic cylinder. In any event, it is essential that the pattern plate exchange carriage be movable directly below the downward rotated pattern plate carrier, so that it is necessary to remove only the pattern plate supported on the pattern plate carrier and to raise a substituting pattern plate toward the pattern plate carrier.

For raising or lowering the pattern plates being exchanged, it would be possible to provide in a further advantageous manner, below the pattern plate carrier, a lifting mechanism with a receiving device, which can be moved, respectively for removing or lowering, or for raising or installing the pattern plate, toward same or toward the pattern plate carrier. Once the pattern plate exchange carriage is positioned, the lifting mechanism or its receiving device can extend through the pattern plate exchange carriage, so that the pattern plate can be removed from the pattern plate carrier, or raised from the pattern plate exchange carriage, and that it can again be deposited thereon.

In the case of removing a pattern plate from the pattern plate carrier, it is necessary that the pattern plate be first disengaged from the carrier. To this end, the receiving device of the lifting mechanism may be provided with preferably two disengagement cylinders for opening and closing a pattern plate clamping connection that is arranged on the pattern plate carrier. After disengagement, the receiving device takes over the released pattern plate and lowers same to the pattern plate exchange carriage. When raising a substituting pattern plate, the disengagement cylinders will again act upon the pattern plate clamping connection, this time for securing or clamping the substituting pattern plate to the carrier.

With respect to a very fast and successive removal of the old pattern plate in use and an exchange for a new pattern plate, it will be particularly advantageous, when the pattern plate exchange carriage has at least two supports for receiving the pattern plates, and when it can be positioned with the respective receiving support or pattern plate below the preferably downward rotated pattern plate carrier and above the lifting mechanism or its receiving device. In such an event, it is only necessary to remove or lower the pattern plate being replaced, and to raise the substituting pattern plate from the exchange carriage and to push same toward, and secure it to the empty pattern plate carrier.

The method of changing pattern plates in accordance with the present invention includes the steps of releasing and removing a pattern plate from the pattern plate carrier, and then releasably mounting on the pattern plate carrier a substituting pattern plate which has been pre-heated to its working temperature. Therefore, within the scope of the method in accordance with the invention, it is likewise not necessary to heat the pattern plate in the machine. Instead, a new pattern plate for making Croning shell molds can be used immediately after an exchange, without heating the pattern plate in the machine. It is only necessary to maintain the process temperature.

In a further advantageous manner, the method of the present invention is characterized by the following detailed steps:

First, the pattern plate carrier is disengaged from the pouring vessel by raising same. Thereafter, the pattern plate carrier can be rotated, preferably about a central axis of rotation, and it can be pivoted or rotated, together with the pattern plate, preferably by 180°, to a downward directed transfer position. Subsequently, a pattern plate exchange carriage is moved or brought below the now downward rotated pattern plate carrier.

By means of a lifting mechanism, a receiving device is now moved toward the downward rotated pattern plate, the pattern plate being disengaged by means of the receiving device or disengagement cylinders associated thereto. After disengaging the pattern plate, same is lowered onto a free receiving support of the pattern plate exchange carriage. Thereafter, the pattern plate exchange carriage is positioned below the pattern plate carrier for positioning the preheated substituting pattern plate. Same is then raised by the receiving device and pushed against the until now empty pattern plate carrier. In like manner as for its release, but only in the reversed sense, the substituting pattern plate is now again secured to the pattern plate carrier by means of the disengagement cylinders. Thereafter, the lifting mechanism or the receiving device retract, so that the pattern plate exchange carriage is able to move again out of the working or pivoting range of the pattern plate carrier.

Finally, the pattern plate carrier is rotated back and reconnected to the pouring vessel by lowering same. The production of new Croning shell molds may proceed after a completed tool change.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENT

Figure 1A:
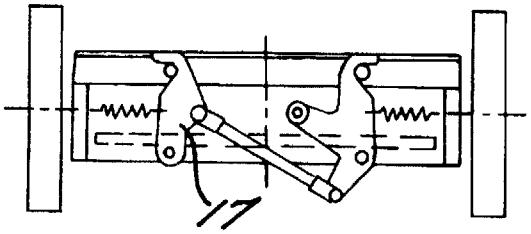
FIG. 1A is a side elevation view of the pattern plate carrier of the apparatus of the invention.

Shown in FIGS. 1–9 are the individual operating steps, which a tool change apparatus of the present invention performs when changing pattern plates during the production of Croning shell molds not shown in the figures. A pattern plate 1 that is in use has a working temperature from about 250° C. to 330° C.

In accordance with the invention, a preheating device 3 is provided, which is used to prepare a substituting pattern plate 2 and to maintain same at the working temperature.

As best seen in the figures, the preheating device 3 is associated with a pattern plate exchange carriage 4. Same serves on the one hand to prepare the substituting pattern plate 2 and, on the other hand, to receive the pattern plate 1 that is replaced. To this end, the pattern plate exchange carriage 4 is provided with two supports 5 for receiving two pattern plates 1, 2, each support 5 mounting a preheating device 3. In the illustrated embodiment, the preheating device 3 is a gas burning device. The preheating devices 3 of both supports 5 can be activated independently of each other.

The tool changing device of the present invention is a device which is to be viewed in combination with a pattern plate carrier 6 and a pouring vessel 7. The pattern plate 1 in use is supported by pattern plate carrier 6, which is rotatable about a horizontal axis and connected, via a coupling device 8, with pouring vessel 7 that is rotatable likewise about a horizontal axis. By pivoting the pouring vessel 7 upward, same releases the pattern plate carrier 6, so that after its disengagement, the pattern plate carrier 6 can be rotated, together with the pattern plate 1, by 180° to a downward directed transfer position.

More specifically, the pouring vessel 7 is rotatable by means of a pivoting device 10 that is operative via a rocking lever 9, namely about an axis of rotation provided on the side of pouring vessel 7, which faces away from pattern plate carrier 6. In contrast therewith, the pattern plate carrier 6 is rotatable about a horizontal axis formed in its center, or it is freely rotatable after disengaging from pouring vessel 7. Essential is in any event that the axes of rotation of pouring vessel 7 and of pattern plate carrier 6 extend parallel to one another, namely perpendicular to the plane of the figure.

Furthermore, as clearly shown in the figures, the coupling device 8 comprises a coupling claw 11 associated with the pouring vessel 7 and a coupling shaft 12 associated to the pattern plate carrier 6, as well as coupling rolls 13. As regards the operation of the coupling device 8, the foregoing description is herewith incorporated by reference.

Still further shown in the figures is that the pattern plate exchange carriage 4 can brought or moved below the downward rotated pattern plate carrier 6. To this end, reference may be made in particular to FIGS. 4–8. The pattern plate exchange carriage 4 is designed for movement by hand, or an electric motor, or via a hydraulic or pneumatic cylinder, which is left open in the illustrations selected in the figures.

Provided below the pattern plate carrier 6 is a lifting mechanism 14 with a receiving device 15, which can be moved, respectively for removing or lowering, and for raising or installing pattern plate 1, 2, toward same or toward the pattern plate carrier 6. As further shown in the figures, the receiving device 15 mounts two disengagement cylinders 16 for opening and closing a pattern plate clamping connection 17 which is provided on pattern plate carrier 6. This clamping connection 17 is best seen in FIG. 1A.

Finally, as can be noted from the sequence of the method steps shown in FIGS. 4–8, the pattern plate exchange carriage 4 can be positioned with the particular support 5 or pattern plate 2 below the downward rotated pattern plate carrier 6 and above the lifting mechanism 14 or receiving device 15.

As previously indicated, the sequence selected in FIGS. 1–9, shows the individual steps of the method of changing pattern plates during the production of Croning shell molds with the use of a tool changing device in accordance with the invention, as has been described above in more detail. Essential is in any event the fact that a pattern plate 2 which is prepared for an exchange, be preheated to the working temperature and maintained thereat, so that a heating of the new pattern plate 2 in the machine is no longer necessary. With reference to FIGS. 1–9, the particularly advantageous steps of the method in accordance with the invention are briefly described in the following.

Figure 1:
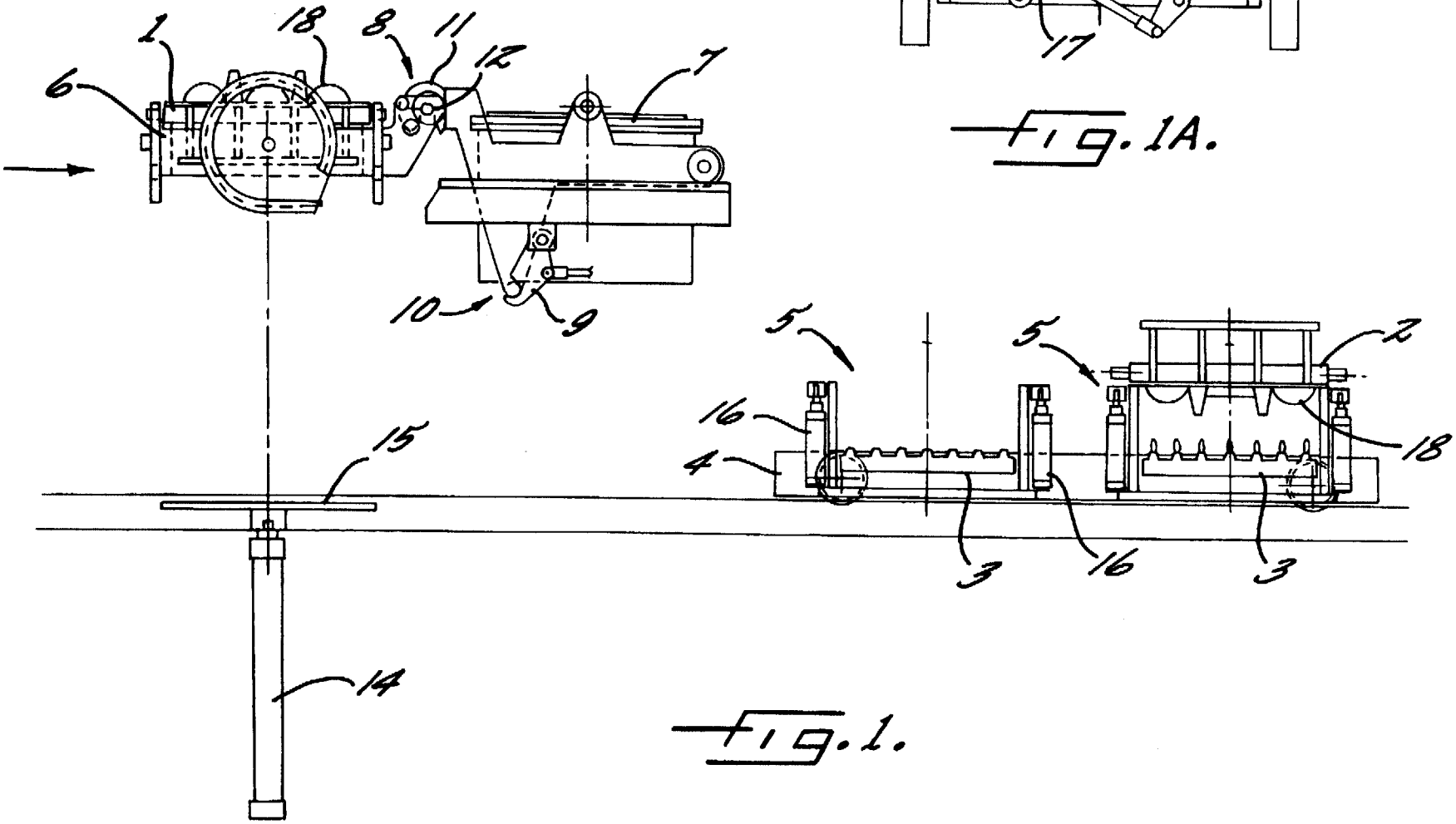
FIGS. 1–9 are schematic side views of an embodiment of a tool changing apparatus in accordance with the invention, the figures illustrating a sequence of individual steps of the method during a tool change.

FIG. 1 illustrates pattern plate carrier 6 mounting pattern plate 1 which is in use. The pattern plate carrier 6 is connected, via coupling device 8, to pouring vessel 7. Moreover, FIG. 1A shows in a separate view, a clamping connection 17, which secures the pattern plate 1 to pattern plate carrier 6. The pattern on both pattern plates 1, 2 is indicated only by its contour 18.

Figure 2:
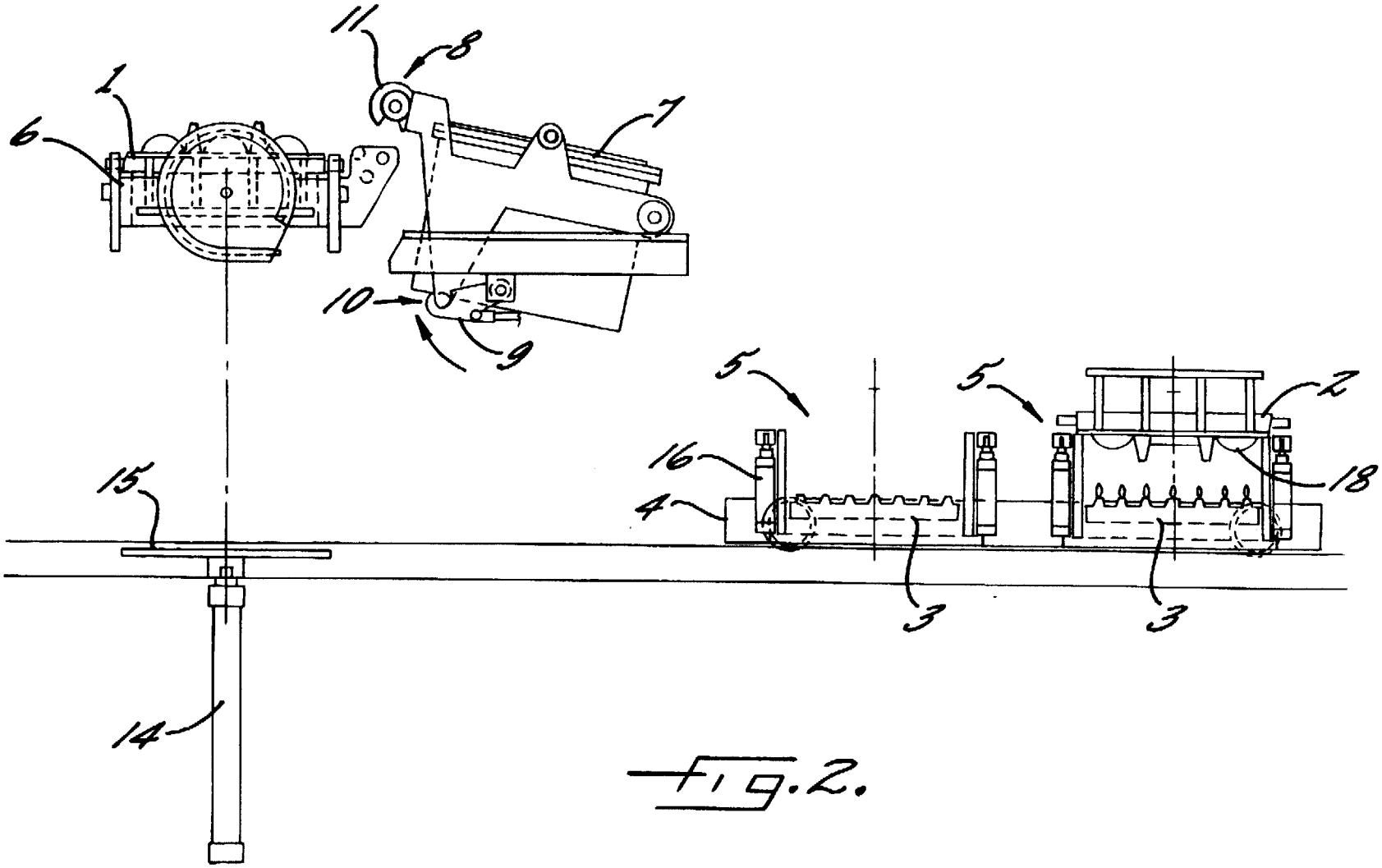
Figure 3:
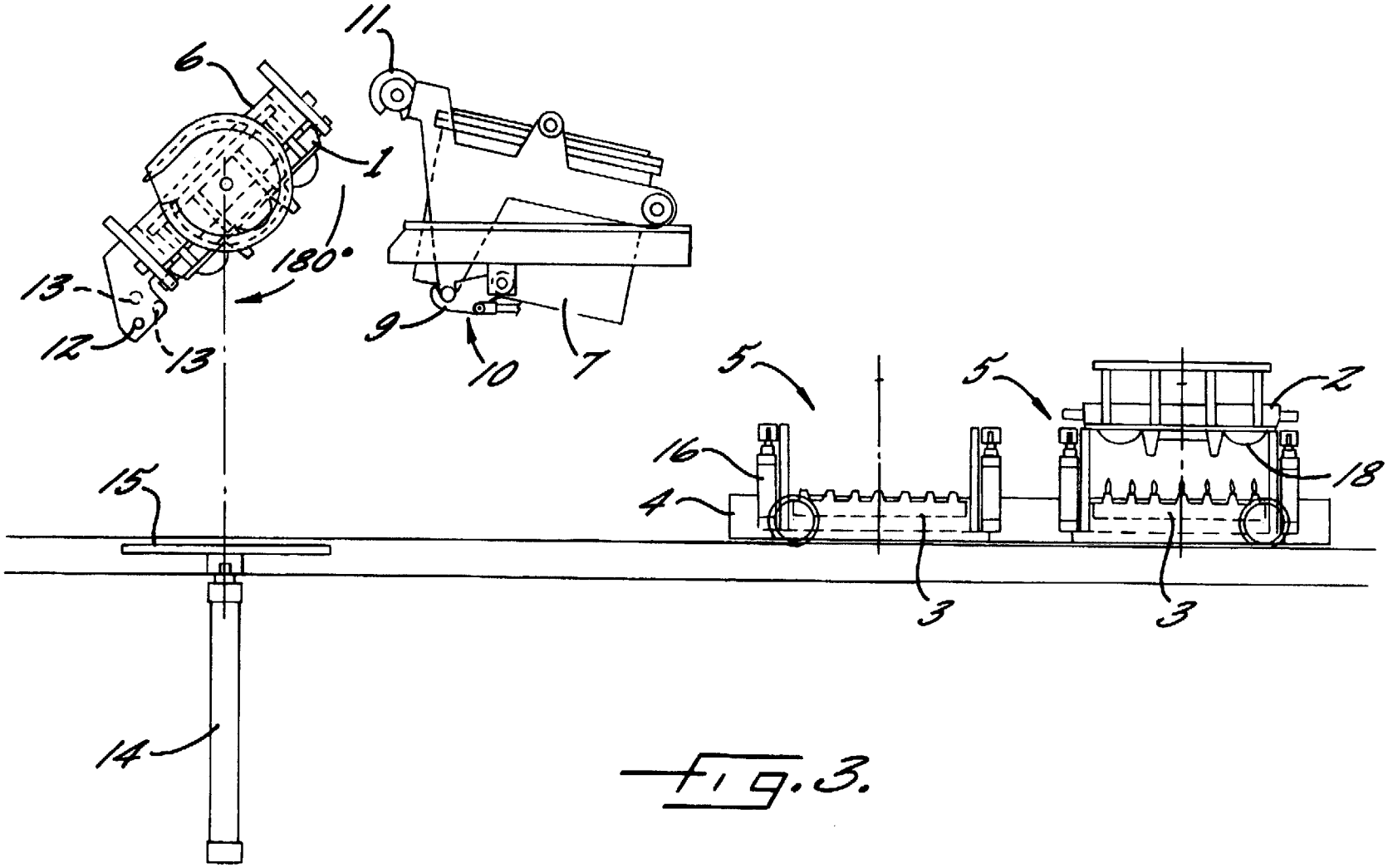
Figure 4:
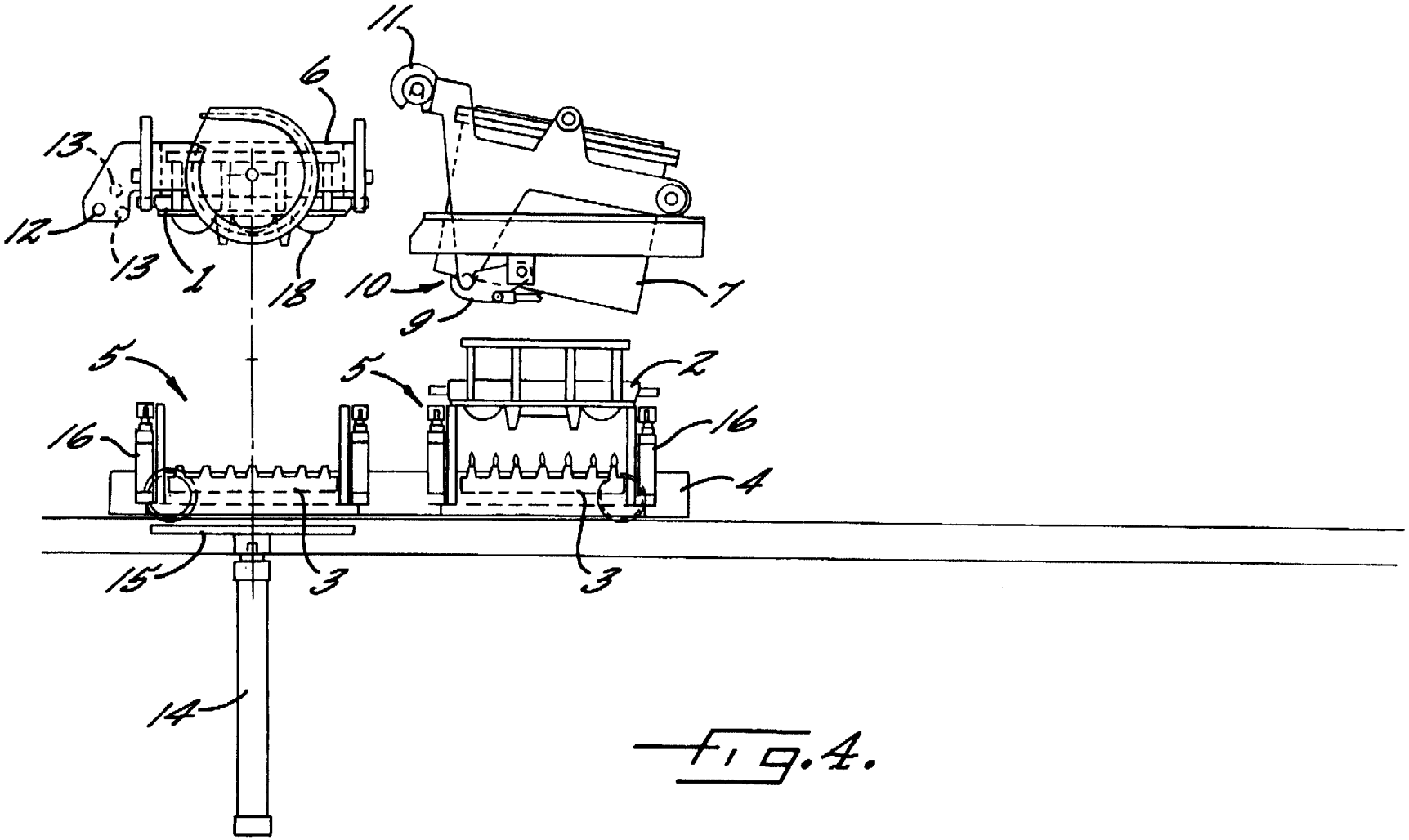

As illustrated in FIG. 2, the pouring vessel 7 is already tilted upward by means of pivoting device 10, so that the pattern plate carrier 6 is disengaged. In FIG. 3, the pattern plate carrier 6 rotates, together with pattern plate 1 still secured thereto, by 180°, so that the pattern plate 1 is directed downward, as shown in the illustration selected for FIG. 4. As this point in time, as can be noted from the embodiment selected for FIG. 4, the pattern plate exchange carriage 4 has moved already below the downward rotated pattern plate carrier 6, with the empty support 5 of pattern plate exchange carriage 4 being positioned exactly below the pattern plate carrier 6.

Figure 5:
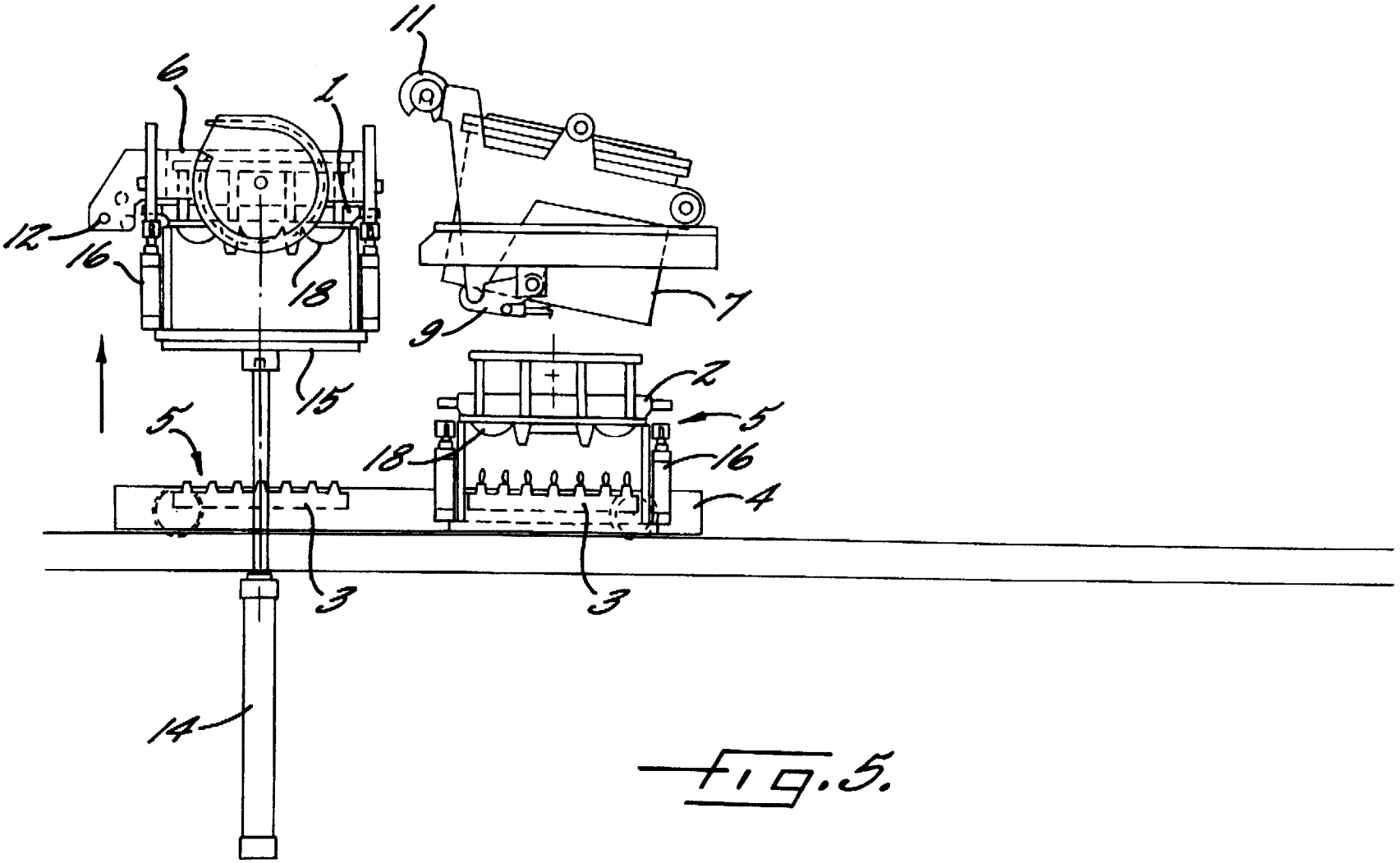
Figure 6:
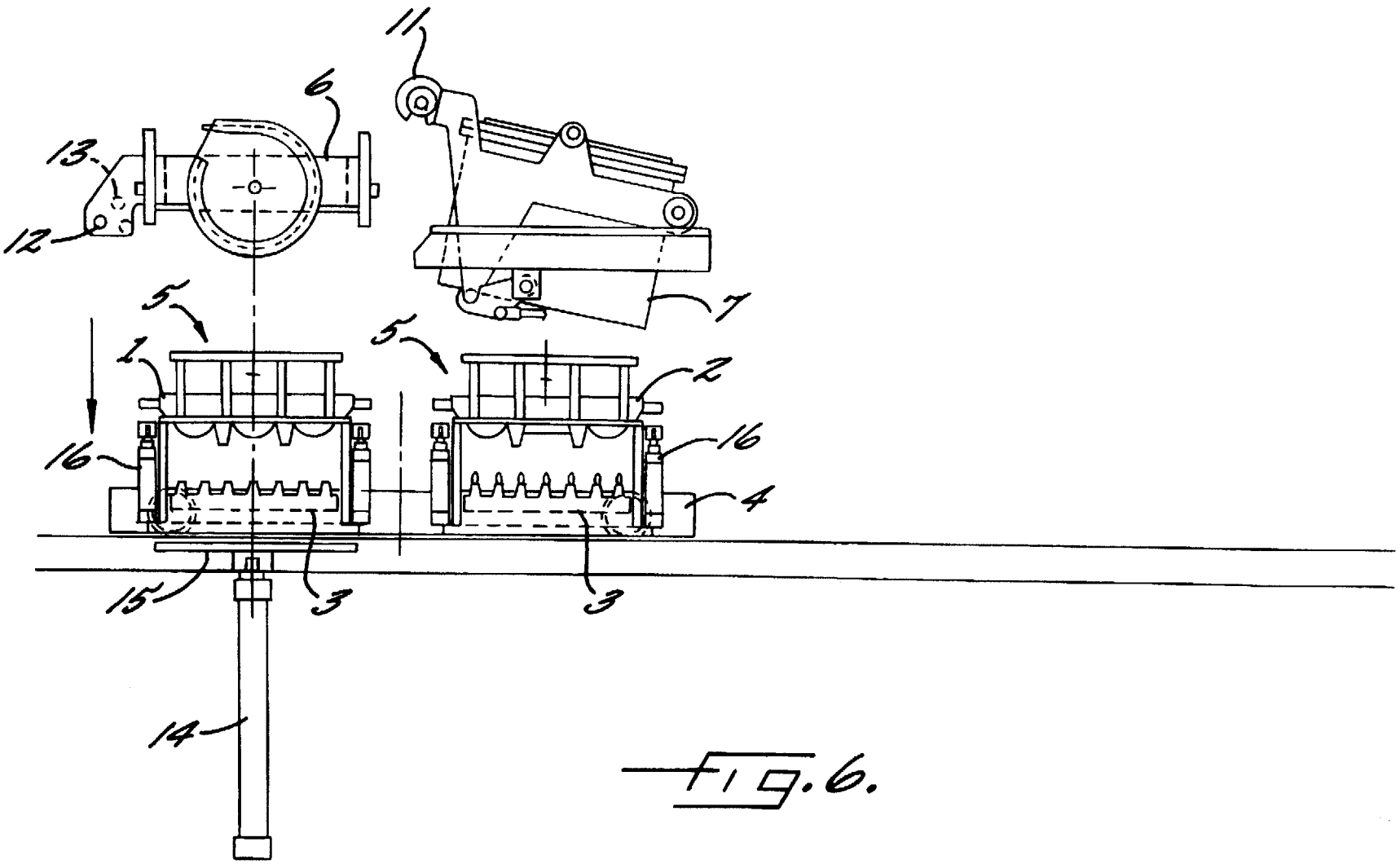

As best seen in FIG. 5, for the actual exchange of pattern plates, the receiving device 15 of lifting mechanism 14 moves toward the downward rotated pattern plate 1. In this process, the pattern plate 1 is disengaged by means of disengagement cylinders 16 associated with receiving device 15. Accordingly, the pattern plate 1 can now be received by receiving device 15 and be lowered onto the free support 5 of pattern plate exchange carriage 4. To this end, reference may be made to FIG. 6.

Figure 7:
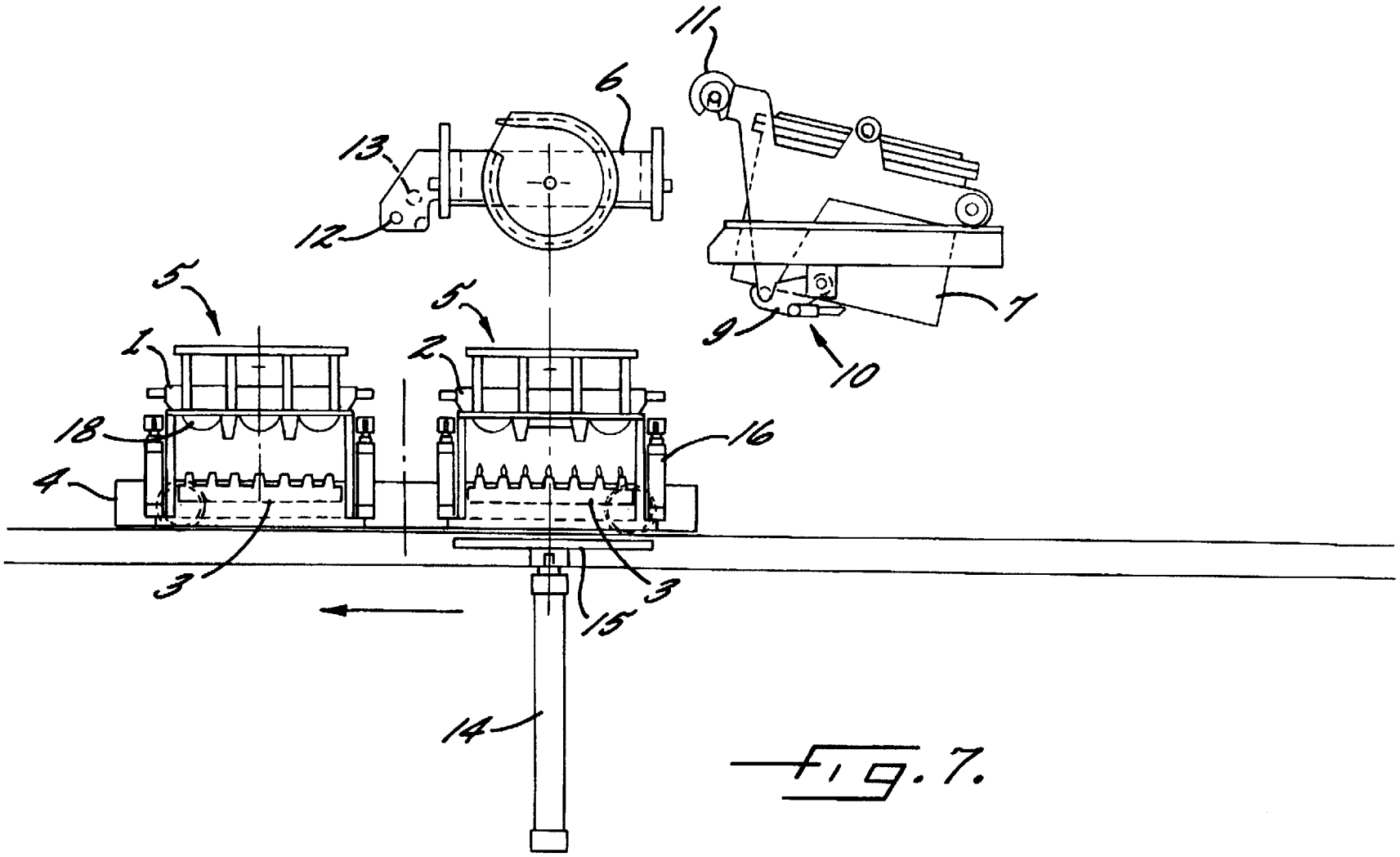

FIG. 7 shows a further step of the method, wherein the pattern plate exchange carriage 4 has again been moved, namely for positioning the preheated substituting pattern plate 2 exactly below the now empty pattern plate carrier 6.

Subsequently, the preheated substituting pattern plate 2 is raised by means of receiving device 15 or lifting mechanism 14 toward the empty pattern plate carrier 6. The pattern plate 2 is secured, again by disengagement cylinders 16, but in reversed manner to the aforesaid release of the pattern plate 1 that is replaced.

Figure 8:
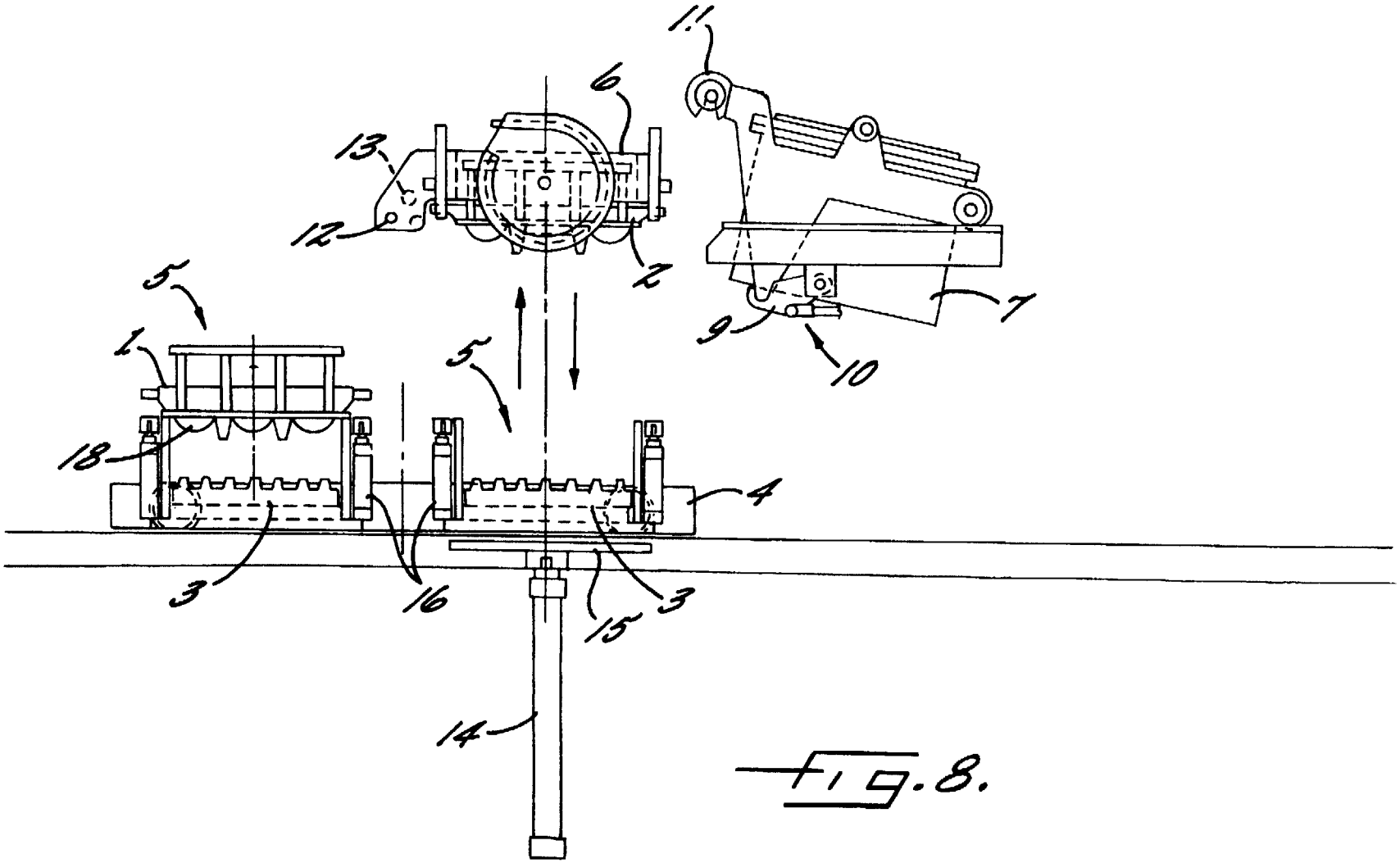
Figure 9:
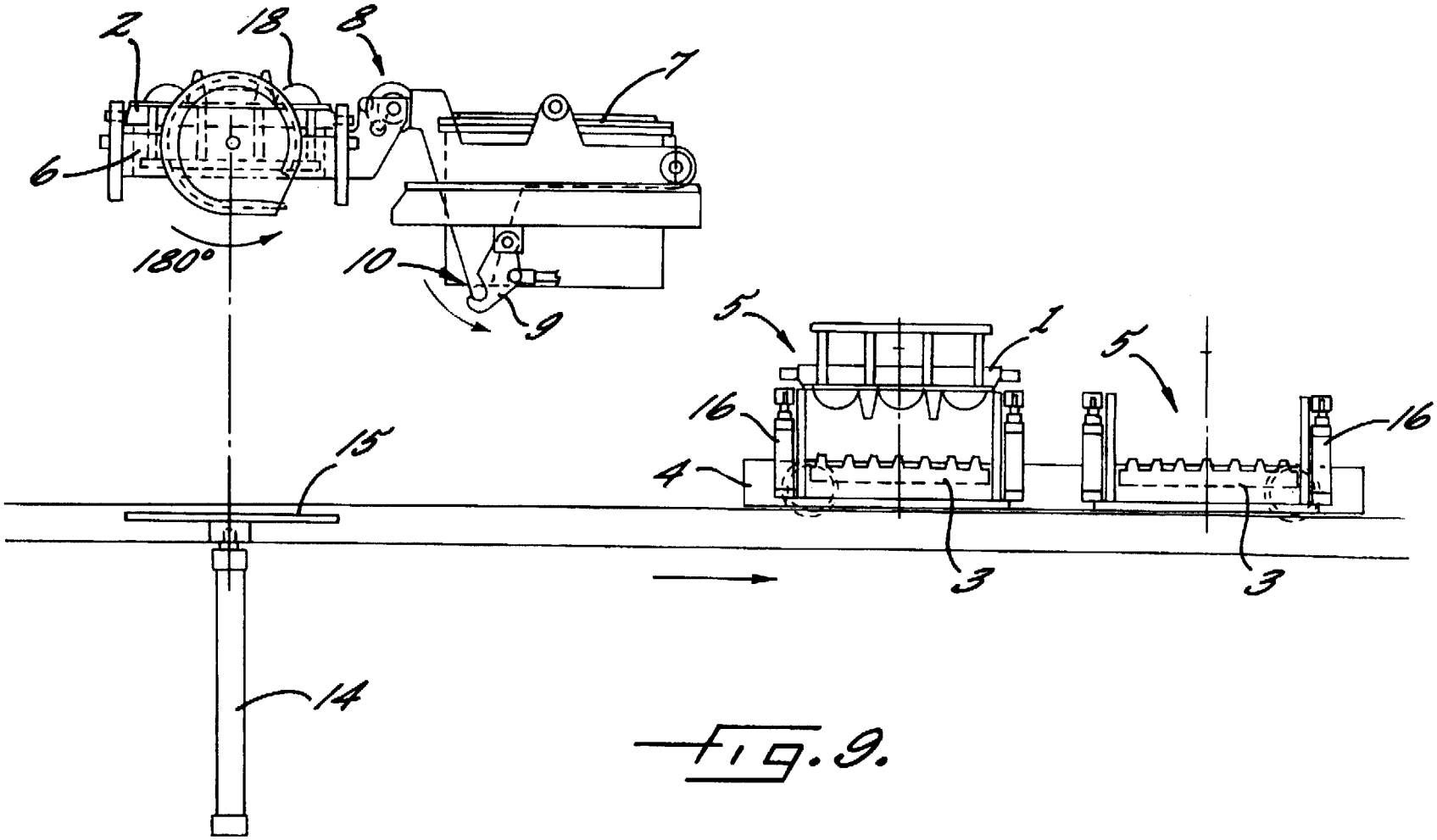

As shown in FIG. 8, the empty receiving device 15 is retracted, so that the support 5 having originally carried the substituting pattern plate 2 remains empty. Subsequently, the pattern plate exchange carriage 4 is moved out of the working or pivoting range of pattern plate carrier 6, so that same can be rotated to its upward directed position, and be engaged with pouring vessel 7 by lowering same. This state is shown in FIG. 9, wherein the pattern plate exchange carriage 4 having been moved sideways carries now the replaced pattern plate 1, which may, for example, be cleaned or stored. A next tool change will occur in accordance with the foregoing description.

Finally, it should be noted that the above-described embodiment of a tool change device in accordance with the invention as well as the method steps relating thereto serve only for a descriptive illustration of the teaching of the invention, without limiting same to the foregoing embodiment.

We claim:

1. An apparatus for changing pattern plates in the production of shell casting molds comprising a pattern plate carrier for releasably mounting a pattern plate, means mounting said pattern plate carrier for rotation about a horizontal axis and between an upright position and an inverted position, and pattern plate changing means for removing a pattern plate from the pattern plate carrier and replacing the removed pattern plate with a pre-heated substituting pattern plate while the pattern plate carrier is rotated to said inverted position.

2. The apparatus as defined in claim 1 wherein the pattern plate changing means comprises a carriage having at least two supports, with the carriage being movable so that each of the supports may be selectively positioned beneath the pattern plate carrier in the inverted position.

3. The apparatus as defined in claim 2 wherein each of said supports includes a receiving device for supporting a pattern plate, and a pre-heating device for pre-heating a pattern plate supported on said receiving device.

4. The apparatus as defined in claim 3 wherein each of said receiving devices is separable from its associated support, and further comprising a lifting mechanism positioned below the pattern plate carrier for lifting a receiving device from a support positioned below said pattern plate carrier so that the receiving device can release and remove a pattern plate from the inverted pattern plate carrier or replace a removed pattern plate with a pre-heated substituting pattern plate.

5. The apparatus as defined in claim 4 wherein said pattern plate carrier includes a releasable clamping connection for releasably mounting a pattern plate thereon, and wherein each of said receiving devices includes means for releasing or closing the clamping connection.

6. The apparatus as defined in claim 5 further comprising a pouring vessel mounted adjacent said pattern plate carrier and so as to be rotatable about a second horizontal axis which is parallel to the axis of rotation of said pattern plate carrier, and a coupling device releasably interconnecting the pattern plate carrier and the pouring vessel so as to permit the pattern plate carrier to be rotatable between said upright and inverted positions upon release of said coupling device.

7. The apparatus as defined in claim 6 wherein said coupling device is releasable upon rotation of said pouring vessel about said second axis.

8. The apparatus as defined in claim 3 wherein said pre-heating device of each of said supports is adapted to heat a pattern plate supported thereon to a working temperature of between about 250 degrees C. and about 330 degrees C.

9. A method of changing pattern plates during the production of shell casting molds and utilizing a pattern plate carrier which is configured to releasably mount a pattern plate, and comprising the steps of rotating the pattern plate carrier which mounts a pattern plate from an upright position to an inverted position, releasing and removing the pattern plate from the pattern plate carrier while in said inverted position, and then releasably mounting on the pattern plate carrier a substituting pattern plate which has been pre-heated to a working temperature of between about 250 degrees C. and about 330 degrees C.

10. The method as defined in claim 9 wherein the pattern plate carrier is mounted for rotation about a horizontal axis and between the upright position and the inverted position, and wherein the step of releasing and removing the pattern plate from the pattern plate carrier comprises moving a first support to a position below the inverted pattern plate carrier, lifting a receiving device from the first support to the inverted pattern plate carrier and releasing the pattern plate therefrom so that the pattern plate is supported on the receiving device, and lowering the receiving device and the supported pattern plate to the first support.

11. The method as defined in claim 10 wherein the step of releasably mounting on the pattern plate carrier a substitute pattern plate comprises the steps of moving a second support to a position below the inverted pattern plate carrier, with the second support supporting the substituting pattern plate which has been pre-heated to said working temperature, lifting the pre-heated substituting pattern plate from the second support, and securing the lifted substituting pattern plate to the inverted pattern plate carrier.

12. The method as defined in claim 11 comprising the further subsequent step of rotating the pattern plate carrier and the secured substituting pattern plate from the inverted position to the upright position.

13. The method as defined in claim 12 wherein a pouring vessel is mounted adjacent said pattern plate carrier and so as to be rotatable about a second horizontal axis which is parallel to the axis of rotation of said pattern plate carrier, and a coupling device releasably interconnects the pattern plate carrier and the pouring vessel so as to permit the pattern plate carrier to be rotatable between said upright and inverted positions upon release of said coupling device, and wherein the step of rotating the pattern plate carrier together with a pattern plate from the upright position to the inverted position includes releasing said coupling device.

14. The method as defined in claim 12 wherein the step of rotating the pattern plate carrier and the secured substituting pattern plate from the inverted position to the upright position includes recoupling said coupling device so as to interconnect the pattern plate carrier and the pouring vessel.

* * * * *